US005138930A

United States Patent [19]

Simon et al.

[11] Patent Number: 5,138,930

[45] Date of Patent: Aug. 18, 1992

[54] LOCKING DEVICE FOR THE BREECH OF AN AUTOMATIC WEAPON

[75] Inventors: Georges H. Simon, Saint Germain du Puy; Joel M. Marcon; Patrice J. Pichot, both of Bourges, all of France

[73] Assignee: Giat Industries, France

[21] Appl. No.: 779,834

[22] Filed: Oct. 21, 1991

[51] Int. Cl.[5] ..... F41A 7/10

[52] U.S. Cl. ..... 89/11; 89/187.01

[58] Field of Search ..... 89/11, 173, 187.01

[56] References Cited

U.S. PATENT DOCUMENTS

| | | | |
|---|---|---|---|
| 1,425,809 | 8/1922 | Thompson | 89/187.01 |
| 4,683,799 | 8/1987 | Post et al. | 89/11 |
| 4,699,040 | 10/1987 | Menges | 89/11 |
| 4,807,513 | 2/1989 | Post et al. | 89/11 |

FOREIGN PATENT DOCUMENTS

| | | |
|---|---|---|
| 0124072 | 11/1984 | European Pat. Off. . |
| 3307882 | 9/1984 | Fed. Rep. of Germany . |

*Primary Examiner*—Stephen C. Bentley

*Attorney, Agent, or Firm*—Parkhurst, Wendel & Rossi

[57] ABSTRACT

The invention relates to a locking device for the breech of an automatic weapon in which the longitudinal movement of the breech (4) is generated by a rotating drum (1) driven by an external motor.

It comprises a locking wedge (6) that moves under the effect of a cam (10) rotated in synchronization with the drum, between a retracted position that allows the free passage of the breech, and a locking position in which the limit surfaces (7,8) working in conjunction on the breech and on the wedge lock the breech in the closed position.

8 Claims, 4 Drawing Sheets

LOCKING DEVICE FOR THE BREECH OF AN AUTOMATIC WEAPON

The present invention relates to a breech locking device for an automatic weapon in which the longitudinal movement of the breech is produced by a rotating drum driven by an external motor.

Such a weapon is known notably via document FR-A-2 372 409. The breech is guided longitudinally and has a roller engaged in a groove of the drum so that the rotating of this produces a reciprocating movement in the breech. It is therefore necessary to keep this locked in the closed position when the ammunition is fired.

The present invention aims to provide a device that permits such locking.

For this purpose, the object of the invention is a breech locking device for an automatic weapon in which the longitudinal movement is produced by a rotating drum driven by an external motor, characterized by the fact that it comprises a locking wedge that moves under the action of a cam rotated in synchronization with the drum, between a retracted position which allows the free passage of the breech and a locking position in which the surfaces of limit stops working in conjunction on the breech and on the wedge lock the breech in the closed position.

The locking wedge may, for example, be driven by a reciprocating translational motion between these two positions.

When the cam is mounted directly on the shaft of the rotating drum and this performs several revolutions per cycle, for example, four revolutions, the device according to the invention comprises disengaging devices to disengage the cam of the locking wedge when the breech is not in the closed position.

These disengaging devices may, for example, comprise at least one fork that pivots under the action of the breech, this fork being arranged so as to cause an axial displacement of the cam.

In a particular embodiment, the fork has on one of the sides of its pivot axis a surface that engages with a roller mounted on the breech and on the other side of its axis, a drive finger that engages in a groove of the cam. The device according to the invention also comprises support devices for supporting the cam in the disengaged position, for example, an interlocking device controlled by the breech for engaging in the aforementioned groove.

This interlocking device may, for example, pivot about an axis and be actuated by two pushers arranged on either side of the axis and working in conjunction with ramps made on the breech.

In a particular embodiment, the cam works in conjunction with two rollers mounted on the locking wedge, one of the rollers being able to be mounted on a lever pivoting on the wedge in order to retract this roller and thus lock the wedge in the locked position if no recoil of the weapon occurs.

Figure 1:
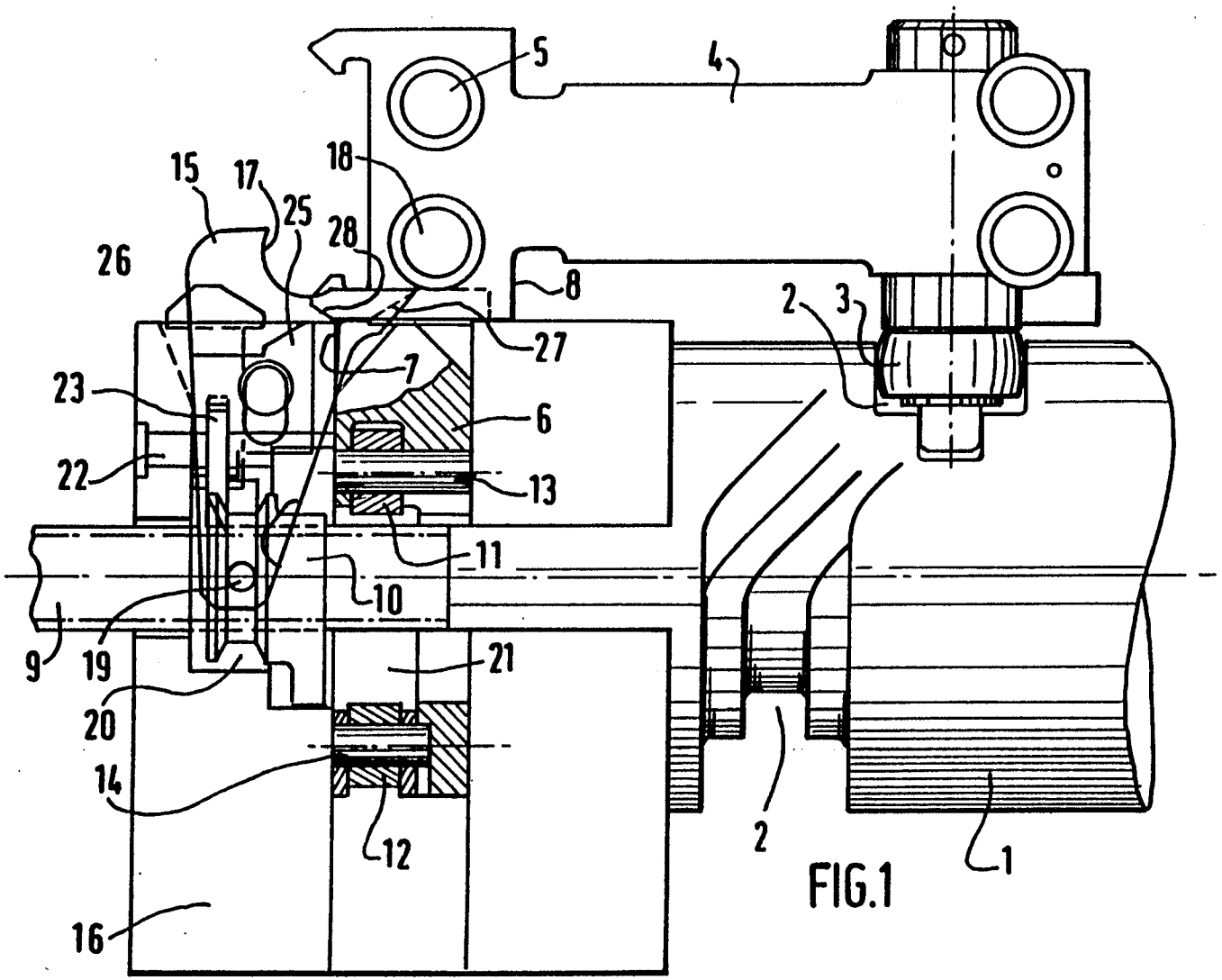
Figure 2:
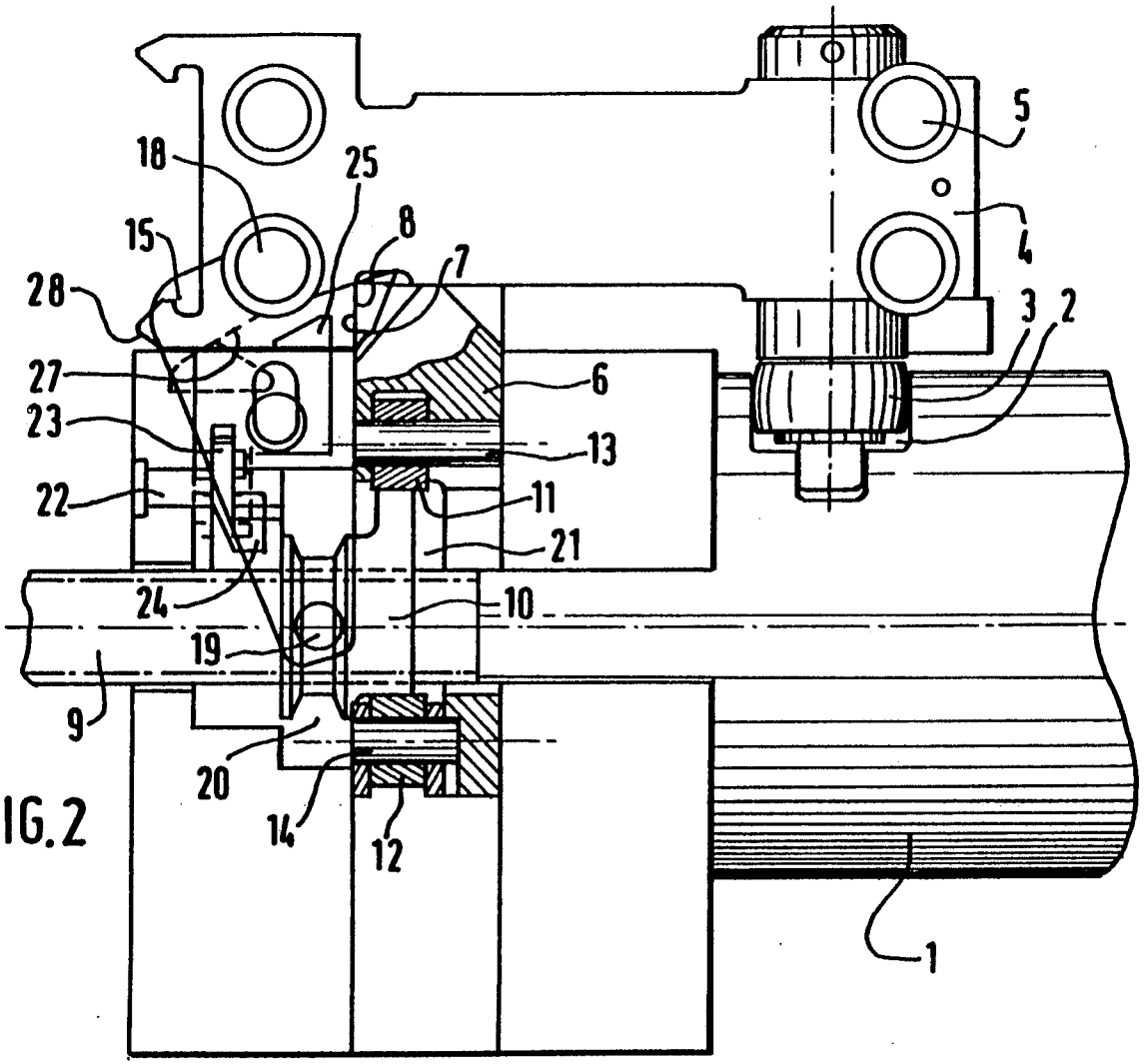
Figure 4:
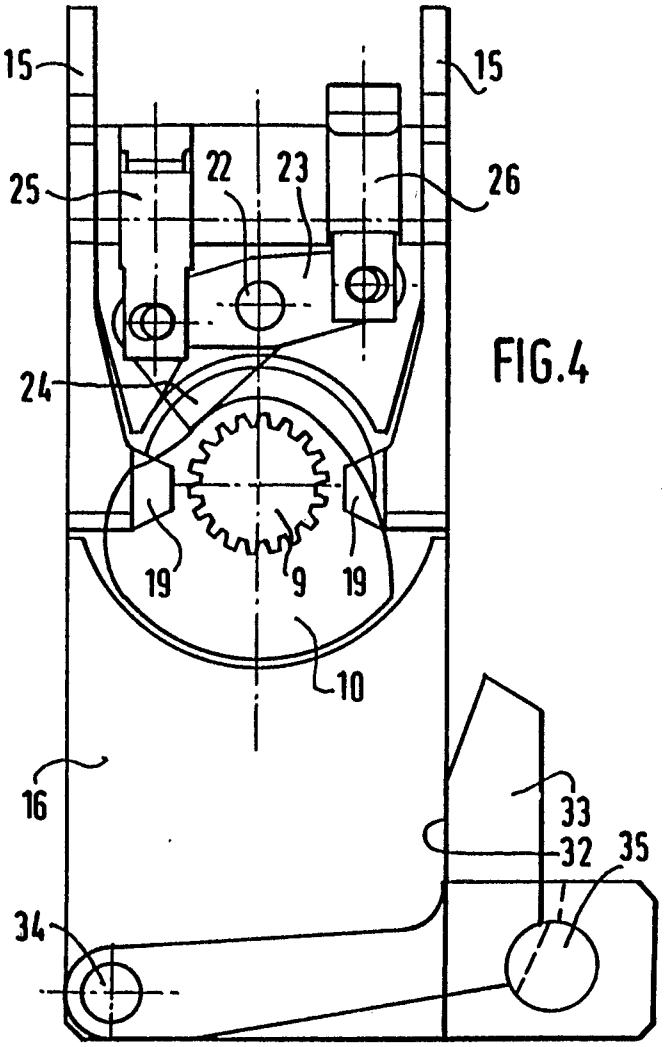
Figure 3:
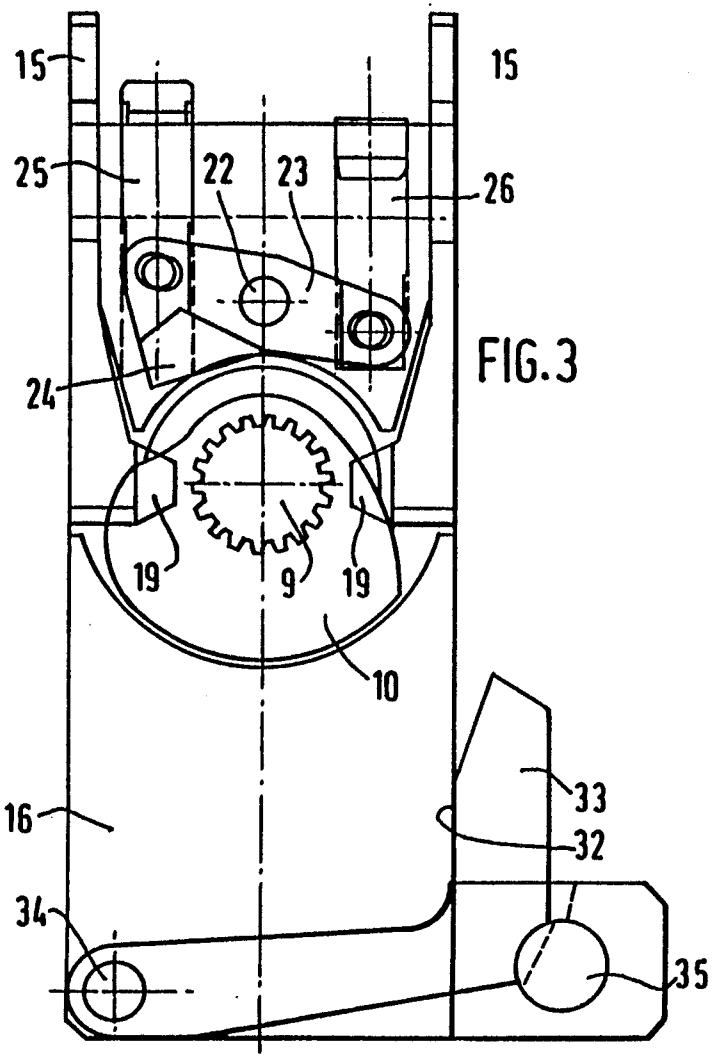
Figure 5:
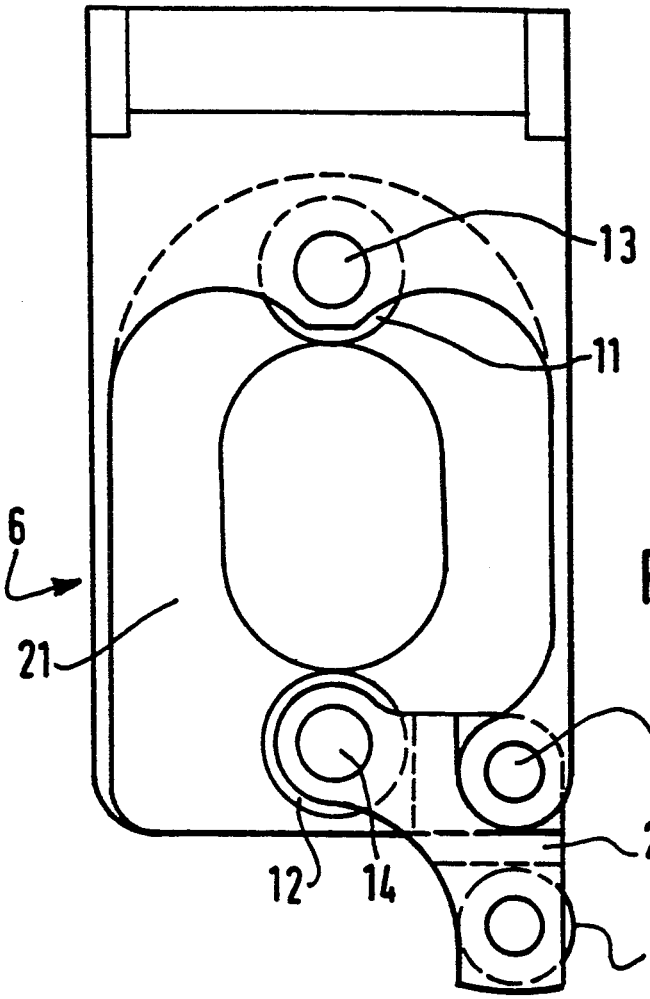
Figure 6:
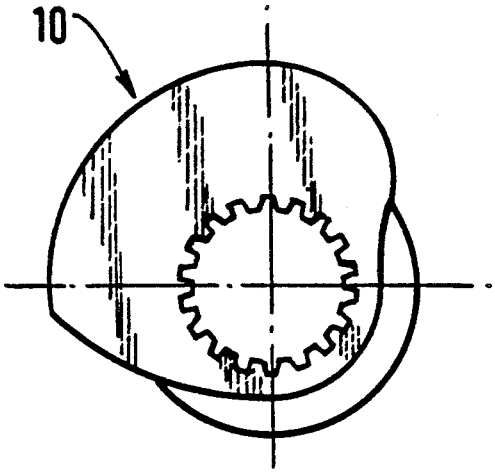
Figure 7:
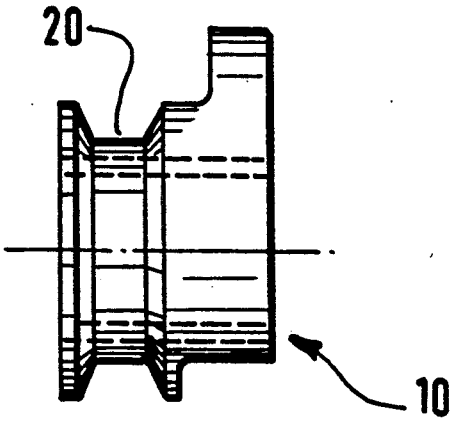

By way of a non-exhaustive example, a particular embodiment of the invention will now be described, with reference to the diagrammatic drawings appended in which:

FIG. 1 is an overall side view of the device according to the invention with the breech in the open position, FIG. 2 is a similar view to FIG. 1 with the breech in the closed position, FIG. 3 is an axial view of the cam and its control devices when the cam is in the engaged position, FIG. 4 is a similar view to FIG. 3 with the cam in the disengaged position, FIG. 5 is a front view of the locking wedge, FIG. 6 is a front view of the cam, and FIG. 7 is a side view of this.

FIGS. 1 and 2 show the rotating drum 1 and its helicoidal groove 2 in which a roller 3 is mounted on the breech 4. The drum is driven by a motor that is not shown.

The breech is also fitted with guiding rollers 5 so that a rotary motion of the drum 1 causes a longitudinal to-and-fro movement of the breech.

The locking of the breech in the closed position is obtained using a locking wedge 6 that has a limit surface 7 that works in conjunction with a limit surface 8 of the breech.

A crenellated part 9 of the shaft of the rotating drum 1 holds a cam 10 that enables a vertical reciprocating movement to be given to the wedge 6. For this purpose, the cam works in conjunction with two rollers 11 and 12 carried by spindles 13 and 14 respectively and mounted on the wedge. Two forks 15 pivot on the carriage 16 of the weapon and have on one of their sides a surface 17 in the shape of a hook in order to work in conjunction with a roller 18 of the breech and on their other side a pin 19 engaged in a groove 20 of the cam 10. Thus, when the breech 4 reaches the locking position, its roller 18 engages in the surface 17 and thus makes the forks 15 pivot which push the cam 10 into the housing 21 of the wedge between rollers 11 and 12, so that the cam and the wedge are engaged. The opening of the breech causes or results in a swinging of the forks 15 in the opposite direction, the cam 10 coming out of the housing 21 and hence being disengaged from the wedge.

The carriage 16 also supports a spindle 22 on which is mounted a lever 23 that is rigid with a latch 24 that may engage in the groove 20 of the cam 10 in order to keep this in the disengaged position.

The lever 23 is controlled by two pushers 25 and 26 that slide vertically under the action of ramps 27 and 28 of the breech respectively.

Finally, on FIG. 5 it can be seen that the roller is mounted at one end of a lever 29 that pivots on wedge 6 about a spindle 30 and carries at its other end a roller 31. The lever 29 is maintained in the position shown in the drawing by the back pressure of the roller on a surface 32 of a lever 33 that pivots itself around a spindle 34 carried by the carriage 16 of the device.

A shaft 35 that moves axially normally maintains lever 33 in the position shown in FIGS. 3 and 4, apart from in the event of a misfire when it allows lever 33 by any suitable means to pivot about spindle 34 thus removing the support of the roller 31 and retracting roller 12. In this situation, the wedge 6 is hence immobilized in the locked position and the breech 4 remains closed.

Now the functioning of the device described above will be described.

When the breech 4 reaches the closed position, the roller 18 makes the forks 15 swing, the effect of which is to move the cam 10 inside the housing 21 where it engages with the rollers 11 and 12.

The rotating of the cam drives the cam upwards where it locks the breech 4.

Simultaneously, the ramp 28 has caused the sinking of the pusher 26 and the raising of the pusher 25 so as to disengage the latch 24 from the groove 20 of the cam 10. After the shot has been fired, the cam 10 drives the wedge 6 downwards, the effect of which is to unlock the breech. This, setting off again towards the right in FIGS. 1 and 2, the roller 18 again makes the forks 15 swing so that the cam 10 leaves the housing 21 and is therefore again disengaged from the wedge as shown in FIG. 1.

In addition, the surface 27 causes the pusher 25 to sink and the pusher 26 to rise up as shown in FIG. 4, the effect of which is to engage the latch 24 in the groove 20 of the cam 10, and hence immobilize this cam on spindle 9.

Different variants and modifications may of course be made to the preceding description without departing from the scope or the spirit of the invention.

We claim:

1. Breech locking device for an automatic weapon in which the longitudinal movement of the breech is produced by a rotating drum driven by an external motor, comprising a locking wedge that moves under the action of a cam driven in rotation in synchronization with said drum, between a retracted position which allows the free passage of said breech and a locking position in which limit surfaces working in conjunction on said breech and on said wedge lock the breech in the closed position, wherein it comprises disengaging devices to disengage said cam from said locking wedge.

2. Device according to claim 1, wherein said disengaging devices comprise at least one fork that pivots under the action of the breech, the fork being arranged to cause an axial displacement of the cam.

3. Device according to claim 2, wherein said fork has, on one of the sides of its pivoting spindle, a surface for engaging with a roller mounted on said breech, and on the other side of its spindle an actuating pin engaging in a groove of said cam.

4. Device according claim 3, wherein it comprises supporting devices to maintain said cam in the disengaged position.

5. Device according to claim 4, wherein said support devices comprise a latch controlled by the breech for engaging in the groove.

6. Device according to claim 5, wherein said latch pivots about a spindle and is actuated by two pushers arranged on either side of the spindle and working in conjunction with ramps made on said breech.

7. Device according to claim 6, wherein said cam works in conjunction with two rollers mounted on the locking wedge.

8. Device according to claim 7, wherein one of said rollers is mounted on a lever that pivots on said locking wedge in order to retract said roller and thus immobilize said wedge in the locking position if there is no recoil of said weapon.

* * * * *